United States Patent [19]

Coellner et al.

[11] Patent Number: 4,594,860

[45] Date of Patent: Jun. 17, 1986

[54] OPEN CYCLE DESICCANT AIR-CONDITIONING SYSTEM AND COMPONENTS THEREOF

[75] Inventors: James A. Coellner; David S. MacIntosh; Mark C. Blanpied, all of Waco, Tex.

[73] Assignee: American Solar King Corporation, Waco, Tex.

[21] Appl. No.: 653,792

[22] Filed: Sep. 24, 1984

[51] Int. Cl.[4] ..... F25D 23/00

[52] U.S. Cl. ..... 62/271; 165/8; 165/10; 55/390

[58] Field of Search ..... 62/271; 165/8, 10; 55/390

[56] References Cited

U.S. PATENT DOCUMENTS

| | | | |
|---|---|---|---|
| 2,926,502 | 3/1960 | Munters et al. | 62/271 |
| 3,327,771 | 6/1967 | Lecon | 165/10 |
| 3,391,727 | 7/1968 | Topouzian | 165/10 |
| 3,456,718 | 7/1969 | De Fries | 165/10 |
| 3,800,860 | 4/1974 | Johnsson | 165/10 |
| 4,093,435 | 6/1978 | Marron et al. | 55/390 |
| 4,180,126 | 12/1979 | Rush et al. | 62/271 |
| 4,228,847 | 10/1980 | Lindahl | 165/10 |
| 4,255,171 | 3/1981 | Dravnieks | 165/8 |
| 4,491,171 | 1/1985 | Zenkner | 165/10 |

*Primary Examiner*—Ronald C. Capossela

*Attorney, Agent, or Firm*—John E. Benoit

[57] ABSTRACT

An open-cycle air-conditioning apparatus including a rotatable heat exchanger wheel, a rotatable moisture transfer wheel, evaporative elements, and heating means disposed between the heat exchanger wheel and the transfer wheel wherein both wheels are constructed of spaced alternate layers of material mounted on a hub with means for forming a plurality of axial passages in the area between the layers. The moisture transfer wheel has an absorbent material alternating with a rigid polymeric material and the heat exchanger has rigid material of a low thermal conductivity, such as a rigid polymer forming both layers. In each instance, axial passages exist between the layers. Both wheels have outer semi-rigid rims and a plurality of rigid spokes secured to and extending radially from the hub, through the material and the rim for structurally strengthening the wheels and terminating in a threaded end with a cooperating nut for truing the wheel through adjustment of the nuts. Baffles may be included between the two wheels on the air input side so as to prevent undesirable intermingling of air having different temperatures and humidities. A moisture impervious grid may be formed through the absorbent material to prevent migration of the desiccant material contained therein. Solar heat coils are used for the heating requirements.

36 Claims, 12 Drawing Figures

OPEN CYCLE DESICCANT AIR-CONDITIONING SYSTEM AND COMPONENTS THEREOF

This invention relates generally to air-conditioning systems and more particularly to open cycle desiccant air-conditioning systems and to the moisture transfer wheel and the heat exchangers wheel used therein.

BACKGROUND OF THE INVENTION

Open cycle air-conditioners are known in the art and have been based primarily on one system, known as the Munters Environmental Control system (MEC) unit as described in U.S. Pat. No. 2,926,502. As set forth in this patent, the basic open-cycle air-conditioner operates by dehumidification and subsequent cooling of air wherein moist hot air is conditioned by basically a multi-stage process to produce cool air.

In open-cycle air-conditioning systems, a basic multi-step approach is used. Outside air is subjected to removal of moisture through a moisture transfer wheel, with the dried air being cooled by means of a heat exchanger wheel with the subsequent addition of moisture by an evaporative element so as to further cool the air before it enters the area to be conditioned. In the return cycle, the air passes through an exhaust path which includes a further evaporative element, the heat exchanger wheel, a heating element and through the moisture transfer wheel for driving moisture therefrom so as to regenerate the wheel, and is exhausted to the atmosphere.

One of the major advantages of this type of system is that a constant supply of fresh, filtered air is delivered to the space to be conditioned as opposed to the recirculation of air as is found in standard heating and cooling systems.

Known units which have been subject to experimental use provide gas or electrical units in the heating portion of the cycle prior to exhaust through the moisture transfer wheel. Additionally, during the colder winter months, a gas or electrical heating unit may be used in the intake path after the heat exchange wheel for heating the air passing into the area to be conditioned. In this latter mode, the moisture transfer wheel is substantially non-operative.

During recent years, a number of concepts have been proposed for using solar equipment for cooling systems. Among such proposals has been investigations of desiccant air-conditioning systems. However, to applicants' knowledge, no system has been developed which attains a coefficient of performance which would make such systems economically feasible.

The basic principle of the MEC system is that dry warm air can be simultaneously cooled and humidified by contacting it with water vapor. However, in geographic areas where the air is both warm and humid, it must be dried before it can be cooled by evaporation. The efficiency and the effectiveness of an open-cycle air-conditioning system depends upon the ability of the unit to dehumidify the warm moist air input, and upon the effectiveness of the heat exchanger wheel or unit.

Many types of water removal system have been proposed, among which are the rotating moisture transfer wheel which is regenerated in a manner as discussed above. Various desiccants have been proposed for use in this type of wheel. Conventional desiccants used with these wheels are salts, such as lithium chloride, which is used as the drying agent and which is impregnated or sprayed upon the wheel material. Some of the problems involved with the moisture transfer wheels are structural strength, proper balancing and truing and the prevention of "weep". Weep is the condition wherein the salts have a tendency to deliquesce or form aqueous solutions that drip from the wheel. This causes the solutions to either flow out of the unit or to be stripped by the flowing air. When this condition occurs, it leaches the wheel of its absorbent material, substantially reducing its efficiency. With known wheels, this also has a tendency to cause channel collapse or plugging within the wheel. As a result, the amount of the salt used has necessarily been limited to a low level which results in a major reduction in the efficiency of a wheel of given size relative to the removal of moisture from the air.

As to the heat exchanger wheel, operation depends upon the opposite faces remaining at different temperatures. This means that there must be a significant temperature gradient across the wheel in the axial direction. Proposed use of highly thermally conductive material such as metal results in the temperature gradient through the wheel being substantially less, with poor heat exchange and low effectiveness. In the open-cycle air-conditioner system, the heat created by the drying of the air by the moisture transfer wheel must be removed by the heat exchanger wheel. However, migration of the heat axially in the direction of flow of the air through the wheel must be kept to a minimum. If the heat does so migrate, the air stream to be treated exiting from the heat exchanger wheel will not be sufficiently cooled to render the system practical for air-conditioning reasons because the evaporator would not be capable of reducing the higher temperature to an acceptable level of temperature and humidity.

Non-thermally conductive wheel materials such as wax coated asbestos have been previously proposed since they avoid this problem. However, in addition to health hazards, such material presents structural problems relative to balance and truing of the wheel.

Although the thermal gradient across a metallic heat exchanger might be partially counteracted by making the heat exchanger thicker, the increased thickness causes a proportionally increased pressure drop which increases the energy requirement for movement of the required air volume. Additionally, it adds to the weight and bulk of the wheel. To obtain comparable heat exchange in an aluminum wheel of the same design as a wheel which is non-thermally conductive the thickness of the metal wheel would have to be increased due to the difference in thermal conductivity. It has been determined that the maintenance of a suitable temperature gradient across the heat exchanger wheel of an open-cycle air-conditioner is extremely important since the wheel must operate at above 90% effectiveness to provide satisfactory cooling of the treatment stream. A thorough discussion of heat exchangers and the problems inherent therein as relate to the process under consideration is discussed in *Compact Heat Exchangers,* Kays and London, McGraw Hill Book Company.

Various structural configurations have been proposed for improving the effectiveness of metallic heat exchangers, one such proposal being disclosed in U.S. Pat. No. 3,965,695 issued June 29, 1976 wherein a honeycomb type of construction is proposed. This type of construction requires a considerable amount of metallic material and inherently includes particular manufacturing problems as well as creating a wheel of substantial bulk and weight.

A further problem involved in the open-cycle desiccant air-conditioning system is the problem of temperature transfers due to carry over between the cooling half of the cycle and the heating half of the cycle, that is, the intake air path and the exhaust air path. Also, in the known systems, the amount of heat energy required to regenerate the absorbent material has often resulted in a high heat input rate which leads to a poor thermal coefficient of performance (COP) for the system.

Another problem encountered in known systems is that desiccants such as lithium chloride and lithium bromide become chemically unstable and will deteriorate in the presence of products of combustion such as an open gas flame introduced as the heating element preceding the desiccant wheel in the exhaust path. This is due to the mixture of the combustion products of the gas with the desiccant itself.

Accordingly, it is an object of the invention to provide an improved open-cycle air-conditioning systems with increased coefficient of performance.

A further object of the present invention is to provide an improved system operation of an open-cycle desiccant air-conditioning system.

A still further object of the invention is to provide an improved desiccant wheel for more effectively drying the air intake to the system.

A further object of the invention is to provide an improved heat exchanger wheel so as to substantially increase the effectiveness thereof and, thus, the coefficient performance of the entire system.

A still further object of the invention is to more effectively control the mixture of the air transferred between the desiccant wheel and the heat exchanger wheel in the intake air path.

Yet another object of the invention is to provide a means for substantially reducing the transfer of acqeous solutions within the absorbent material of the desiccant wheel.

Still another object of this invention is the use of a solar energy system integrated into desiccant cooling apparatus.

These and other objects of the invention will be obvious from the following description when taken with the accompanying drawings.

SUMMARY OF THE INVENTION

The present invention discloses an open cycle air-conditioning apparatus including a rotatable heat exchanger wheel, a rotatable desiccant carrying moisture transfer wheel, evaporative elements, and heating means disposed between the heat exchanger wheel and the transfer wheel on the exhaust air path. Both wheel are constructed of spaced layers of material mounted on a hub with means for forming a plurality of axial passages in the area between the layers. The moisture transfer wheel has absorbent material alternating with a rigid material and the heat transfer wheel has rigid layers of material having a very low thermal conductivity with the passages formed therebetween. Both wheels have outer semi-rigid rims and rigid spokes for structurally strengthening the wheels, said spokes extending radially from the hub, through the material and the rim and terminating in a threaded end with a cooperating nut for truing the wheel through adjustment of the nuts. Baffles may be included between the two wheels on the air intake side so as to prevent undesirable intermingling of air having different temperatures and humidity levels within the intake air path between the moisture transfer wheel and the heat exchanger wheel. A moisture impervious grid may be formed through the absorbent materials so as to prevent migration of the desiccant material contained therein.

DETAILED DESCRIPTION

Figure 1:
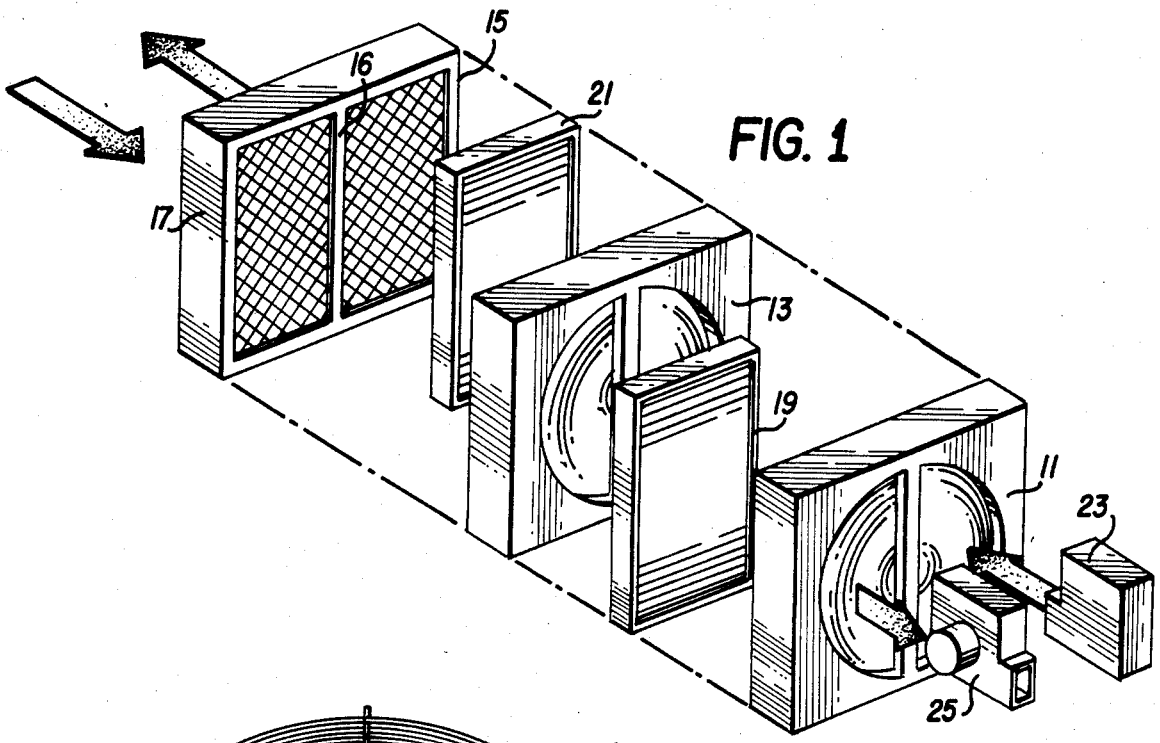
FIG. 1 is a diagrammatic showing of the basic system of the present invention.

Turning now to the drawings, FIG. 1 illustrates a schematic of the basic open-cycle air-conditioning system of the present invention. A moisture transfer wheel 11 constitutes the exterior or outside element of the system. As will be noted and discussed later it is separated into two sections so as to provide an intake path and an exhaust path as indicated by the arrows. A heat exchanger wheel 13, also partitioned so as to provide intake and exhaust paths is located substantially adjacent to wheel 11, separated only by the solar heat regeneration coil 19. Auxiliary solar heating coil 21 may be placed in the system for use in cold months when it is desirable to heat the interior of the area rather than to cool it. The solar coils include fluid pipes which are interconnected with standard solar heating units (not shown). The basic unit terminates in evaporator elements 15 and 17 separated by partition 16 with the arrows indicating the intake air into the building and the air exhausting therefrom. Supply blower 23 and exhaust blower 25 are provided so as to implement the necessary air movement within the system.

As is well known, this type of system provides removal of the moisture from the intake air by the moisture transfer wheel which, because of the moisture removal, increases the temperature of the air which then passes through heat exchanger wheel 13 so as to lower the temperature of the warm dry air. Evaporator element 15 adds moisture to the air, thus reducing the temperature further and supplying cool air to the conditioned area. The exhaust air passes through evaporator element 17 and through heat exchanger wheel 13 so as to remove heat from the heat exchanger and raise the temperature of the exhaust air. The temperature of the exhaust air is further raised by means of solar heating element 19 so as to provide high temperature air in the exhaust path resulting in regeneration of the moisture transfer wheel. The air from the moisture transfer wheel is exhausted into the atmosphere.

The two elements of the system which primarily govern the coefficient performance (COP) of the system are moisture transfer wheel 11 and heat exchanger wheel 13. With the exception of the specific material used in these wheels, they may be constructed in substantially the same manner and may use the same structural support and truing system of the present invention.

Figure 2:
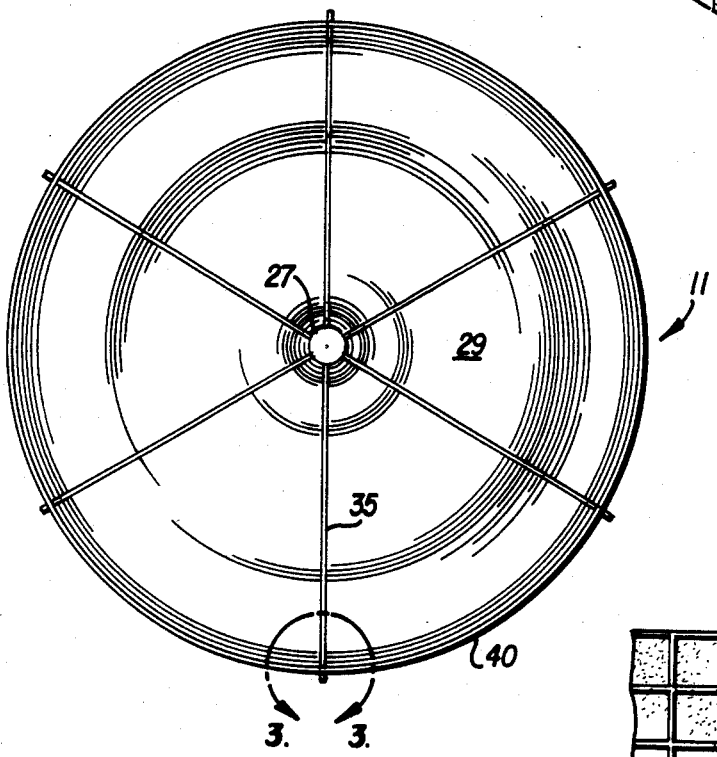
FIG. 2 is a plan view of the wheel construction having the rod supports secured therein.
Figure 3:
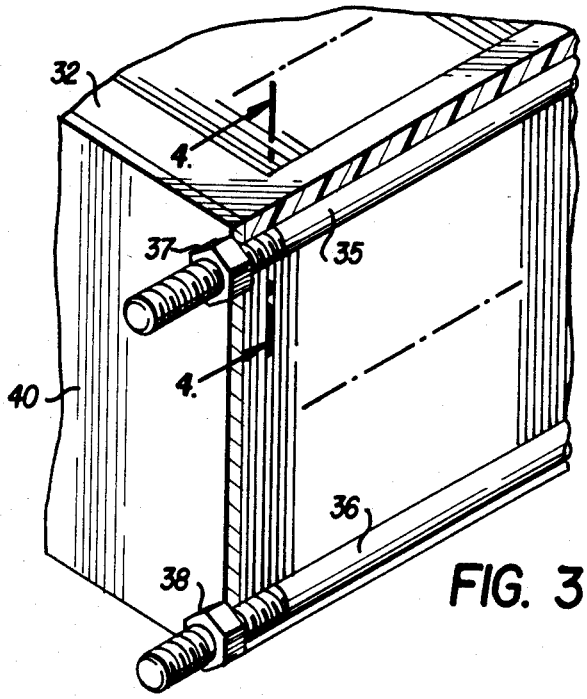
FIG. 3 is a sectional view taken generally along the lines 3—3 of FIG. 2.
Figure 4:
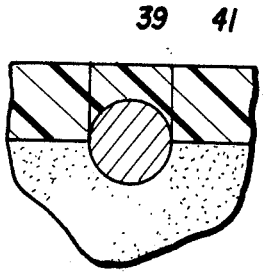
FIG. 4 is a partial sectional view taken along the lines 4—4 of FIG. 3.

FIG. 2 is a plan view illustrating the basic construction of both wheel 11 and wheel 13. The basic wheel matrix 29 is indicated with a subsequent discussion of the materials used therein for the moisture transfer wheel and the heat exchanger wheel. In both wheels, dual continuous rolls of material are slit to the proper width and are tension wound onto hub and shaft assembly 27 until the desired overall diameter is obtained. A plurality of axial passages are formed between the continuous rolls in a manner to be subsequently discussed. Outer rim 40 of semi-rigid material, such as metal rolled to the appropriate curvature, is then installed about the wheel. In a preferred construction method, both faces of the wheel are then routed or grooved so as to provide for the installation of a plurality of rigid spokes 35. Holes are bored through rim 40, and spokes 35, which are threaded at both ends, are passed through the holes in the rim and through the routed slots in the matrix and screwed into pretapped holes in the hub. Referring to FIG. 3, it can be seen that pairs of spokes are disposed on opposite sides of the wheel with the spokes of each pair being axially aligned. The outermost inch of the wheel is also routed about its periphery so as to provide channel 32 as a working area while inserting and adjusting spokes 35. The outer end of rods 35 and 36 are threaded so as to receive nuts 37 and 38. When the rods are in place, they are bonded to the matrix with heat set flexible compound and the routed slots are filled with polyester compound 39 as shown in FIG. 4. Channel 32 on the outer circumference of the wheel is also filled with a polyester compound and the entire wheel is then smoothed so as to meet with the circumferential seals and with the face of the matrix. It is preferred that spokes on opposite sides of the wheel be axially aligned so that the least possible resistance is provided relative to the air passing through the wheel.

Figure 5:
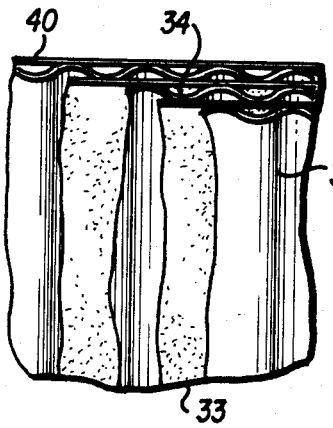
FIG. 5 is a partial break-away view of the moisture transfer wheel of FIG. 1.

FIG. 5 illustrates a preferred internal matrix structure of the moisture transfer wheel 11. A continuous role of polymer film 31 alternates with moisture absorbent material 33 such as paper or non-woven polymer. The polymer film is formed so as to provide a plurality of axial passaes 35. In the illustration of FIG. 5, these passages are formed by a corrugated polymer film. Other possible configurations will be discussed in connection with FIGS. 11 and 12. The wheel is charged with a desiccant solution preferrably lithium chloride, either by a spray application to the wheel bases or by submersion of the wheel in a bath.

Figure 6:
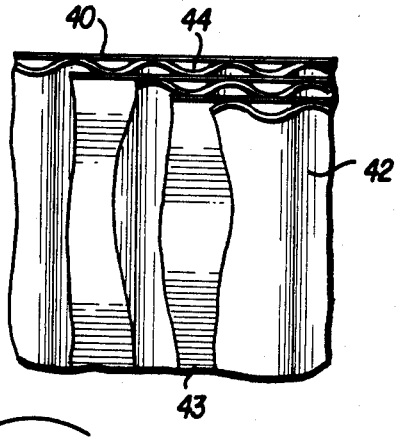
FIG. 6 is a partial break-away view of the heat exchanger wheel of FIG. 1.

FIG. 6 shows the construction of the heat exchange wheel. It is composed of alternating layers of rigid material such as polymer film, each having a low thermal conductivity of less than 3.0 BTU hr./Ft.$^2$° F./in. and high specific heat of at least 0.25 BTU/lb.° F. and having a high density. As discussed above, one of the layers may be formed so as to provide axial passages 44. The particular configuration illustrated in FIG. 6 is corrugated sheet 42. Alternate configurations are discussed in connection with FIGS. 11 and 12. A lower thermal conductivity increases the temperature gradient across the wheel. A high specific heat and density minimizes the required total volume of the ultimate matrix, thereby minimizing not only the weight of the device but the resistance to fluid flows. Tests have shown that the rotary heat exchanger constructed in this fashion with this material has a performance which very closely matches the theoretical predictions of Kays and London in the above mentioned text.

The spoke assembly of both of the wheels provides structural strength for the exchanger which is substantially equivalent to metal wheel as well as a means of adjustment for minimizing axial play while the wheel is rotating. Additionally, using this construction, the wheel can be "trued up" to close tolerances by adjustment of the nuts allowing a highly effective sealing system to prevent loss or entrance of air with the enclosed system.

Figure 7:
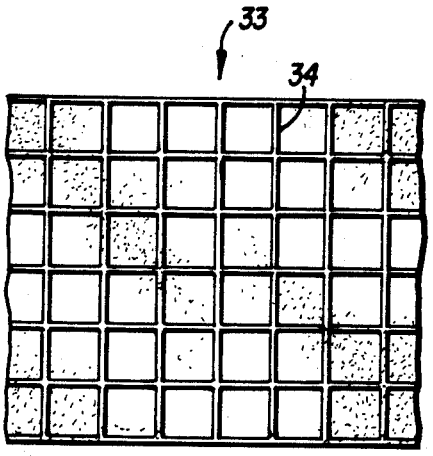
FIG. 7 is a partial view of a section of the moisture absorbent material used in the moisture transfer wheel.

Since lithium chloride liquifies as it absorbs moisture from the air, it is preferred to treat the moisture absorbent material in such a manner such as to prevent migration of this liquid. FIG. 7 shows a preferred method of accomplishing this purpose. Before paper 33 is wound on the hub, it is provided with grid 34 which extends through the material itself. One of the preferred means for obtaining this grid is to soak it with a glue in the grid pattern in thin lines as shown. After the glue dries, solution within one of the square grids will not migrate into an adjacent grid.

Figure 8:
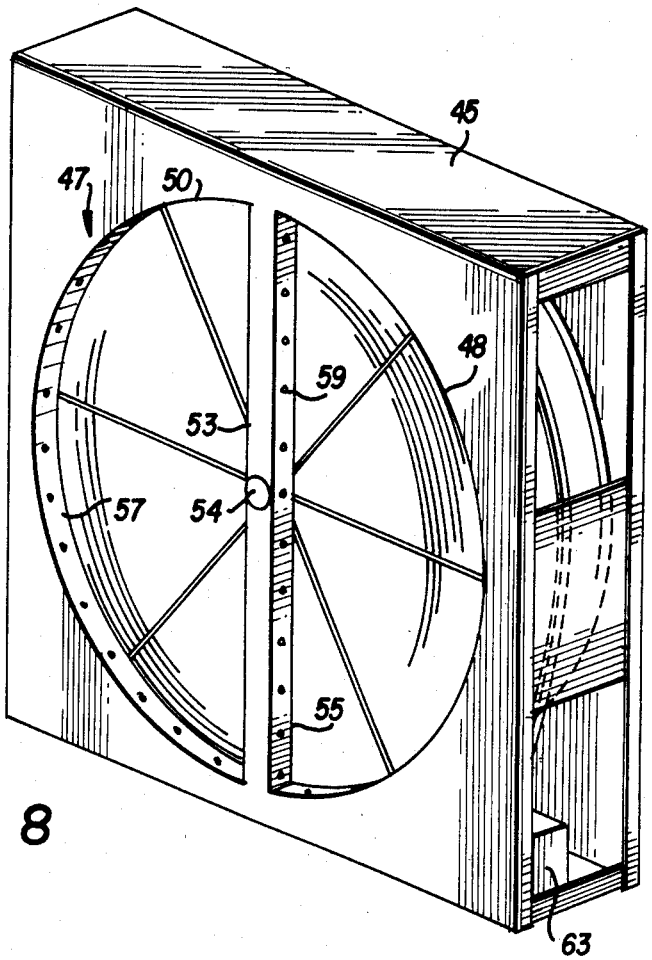
FIG. 8 is a perspective view of one of the wheels of FIG. 1 mounted within a housing.

FIG. 8 discloses a structure for enclosing and supporting either the wheel 11 or the wheel 13. The wheel is shown as supported in housing 45 having a circumferential opening 47 on both sides thereof. The opening is divided into two separate air passages, intake air passage 48 and the exhaust air passage 50 by means of partition 53. The wheel is mounted on axle 54 so as to be freely rotatable within housing 45.

As discussed above, it is essential to assure that the smallest amount of air may pass between intake air passage 48 and exhaust air passage 50 within the system itself. When the system is assembled, all units abut so as to effectively form an air intake duct and an exhaust duct. However, in order to prevent leakage of air between the ducts, sealing strips 55 and 57 of a semi-flexible material such as rubber covered with a low friction surface are secured about the circumference of each of the hemispherical air passages by means such as screws or rivets 59.

Figure 9:
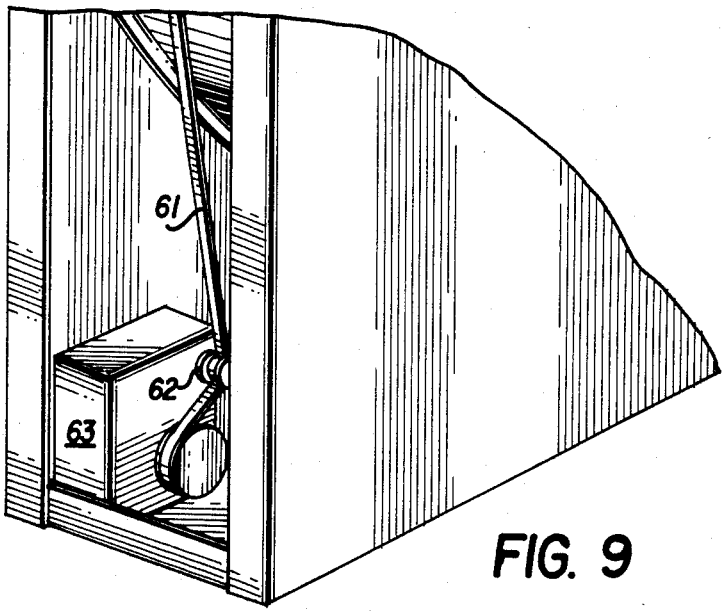
FIG. 9 is a partial perspective view showing a means for rotating the wheels of FIG. 1.

FIG. 9 discloses one means for rotating the wheel which includes a belt 61 driven by a motor 63 with associated pulley 62. It will be appreciated that this is a continuous belt that extends about the drum making contact therewith with the exception of the area adjacent the pulley.

Figure 10:
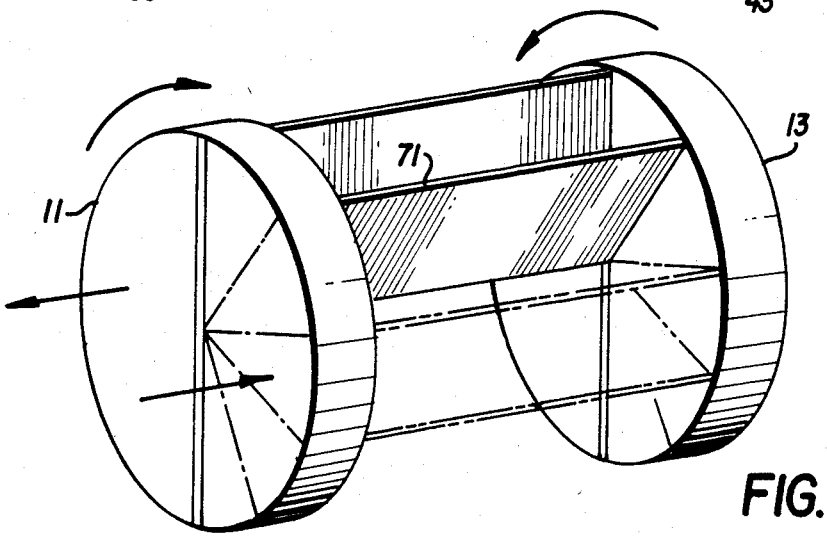
FIG. 10 is a perspective schematic showing the use of baffles within the system of FIG. 1.

Turning now to FIG. 10, there is shown schematically the moisture transfer wheel 11 and heat exchanger wheel 13 as separated by the various partitions within the system together with the use of a baffle 71 between the two wheels. It is to be understood that a number of baffles could be used as indicated by the phantom lines. The baffles are preferably composed of a rigid polymer or other rigid material such as metal, and are oriented parallel to the duct air flow in the intake air passage. The baffles are mounted so as to extend radially from between the axes of the wheels to the outer wall of the duct. As indicated, the baffles extend between the moisture transfer wheel and the rotary heat exchanger and are mounted so as to be in close proximity with the wheel faces at each end of the baffle.

The purpose of the baffles is to prevent mixing of the air exiting from the moisture transfer wheel, which exhibits a marked gradient in temperature and humidity with increasing rotation angle. As indicated, the moisture transfer wheel and the rotary heat exchanger wheel rotate in opposite directions. The air leaving the matrix of wheel 11 in the area which has first entered the supply air stream is the hottest and most humid air in the supply stream, while air leaving from the matrix of wheel 11 in the area which is about to pass beyond the intake air stream will generally be the coolest and least humid. As an example, the temperatures can range from 170° F. for the air in the area which has just entered the supply air stream, to 110° F. for the air in the area which is about to leave the supply air stream as the wheel rotates. The prevention of mixing of these various temperature gradients in the air through the use of baffles improves performance of the air conditioner in two ways. First, it assures that the lowest quality of air in the supply stream is the air which reaches the rotary heat exchanger in the area which is carried over inside the matrix of the rotary heat exchanger 13 to the regeneration air stream. Secondly, maintaining temperature stratification of the air stream results in a radial counter flow effect in the rotary heat exchanger, thus improving its performance. As will be obvious, the matrix of the rotary heat exchanger encounters the coolest air in the area where it first enters the air stream and the hottest air in the area where it leaves the supply air stream. Thus, the air that is carried over into the exhaust stream as the heat exchanger wheel 13 rotates is the hottest air presented into the exhaust path between wheel 13 and wheel 11. As stated, a plurality of baffles may be used as indicated by the dotted lines in FIG. 10 so as to further enhance the separation of the intake air stream.

A comparison was made between a standard metal heat exchanger wheel and the heat exchanger wheel of the present invention without the baffle. The standard wheel used the following material and was of the dimensions indicated. Further, the indicated pressure loss and thermal conductivity is given.

The specifications for the metal heat exchanger wheel are as follows.

| | |
|---|---|
| Material | aluminum |
| Diameter | 48" |
| Depth | 7⅞" |
| Corrugation Height | 0.055" |
| Corrugation Length | 0.157" |
| Recommended Wheel Speed | 20 RPM |
| Pressure Loss | 0.3 in $H_2O$ @ 1200 CFM |
| Thermal Conductivity | 110 BTU/HR · FT.$^2$ · °F./FT |
| Specific Heat | .215 BTU/#°F. |

Test results of this heat exchanger developed the following information which is an average of a plurality of tests.

| | |
|---|---|
| SFPM Face Velocity | 144.77 |
| Energy Balance | .91 |
| Effectiveness | .805 |
| RPM | 14–36 |
| P (Inches $H_2O$) | 0.2 in. |

The specifications for the heat exchanger wheel of the present invention are as follows.

| | |
|---|---|
| Material | Alternate Corrugated are uncorrugated Polycarbonate |
| Diameter | 44" useful diameter |
| Depth | 7⅞" |
| Corrugation Height | 0.06" |
| Corrugation Length | 0.166" |
| Recommended Wheel Speed | 8–15 RPM |
| Pressure Loss | 0.4 inches $H_2O$ @ 1200 SCFM |
| Thermal Conductivity | 0.11 BTU H/Ft.$^2$ °F./Ft. |
| Specific Heat | 0.30 BTU/lb °F. |

The average results of a plurality of tests on this wheel developed the following results.

| | |
|---|---|
| (SFPM) Face Velocity | 189.916 |
| Energy Balance | .9865 |
| Effectiveness | .9360 |
| RPM | 11.666 |
| P (Inches $H_2O$) | 0.37 in. |

As will be quite obvious, the effectiveness of the polycarbonate wheel as opposed to the effectiveness of the metal wheel is very substantial. This is a major factor in increasing the COP of the overall system.

Test results of the overall system for the listed conditions of temperature and humidity developed the following results.

TEST NO. I

| Location | T Avg. Air Temp (F.) | W Avg. Air Humidity (Grains/lb) | H Air Enthalpy (BTU/lb) |
|---|---|---|---|
| 1 Entering D. Wheel | 88. | 103.2 | 37.3 |
| 2 Leaving D. Wheel | 143.4 | | |
| 3 Enter H. Wheel | 136.75 | | |
| 4 Leaving H. Wheel | 74.9 | 67.02 | 28.45 |
| 5 Leaving Evaporator | 64.3 | 87. | 28.97 |
| 6 Entering Evaporator | 78.5 | 94. | 33.55 |
| 7 Entering H. Wheel | 70.9 | 110.7 | 34.28 |
| 8 Leaving H. Wheel | 134.4 | | |
| 9 Entering D. Wheel | 154.9 | | |
| 10 Leaving D. Wheel | | | |

Pressure drop across H. Wheel (inches $H_2O$) - Supply Side: .37 Return Side: .37
SCFM: 840

Temperature Balance on H. Wheel $\frac{(T3 - T4)}{(T8 - T7)}$ : .97

H. Wheel Effectiveness: .939

External Heat Input: (T9 − T8) × .075 × .24 × 60 × CFM: 18600 BTU/Hr

Tons of Cooling $\frac{(H_6 - H_5) \times .075 \times 60 \times CFM)}{12{,}000}$ : 1.44

Coefficient of performance (COP) =

$\frac{\text{Cooling}}{\text{Heat}}$ $\frac{(1.44 \times 12{,}000 \text{ BTU/Hr})}{18{,}600 \text{ BTU/R}} = .93$

TEST NO. II

| Location | T Avg. Air Temp (F.) | W Avg. Air Humidity (Grains/lb) | H Air Enthalpy (BTU/lb) |
|---|---|---|---|
| 1 Entering D. Wheel | 96. | 99.7 | 38.8 |
| 2 Leaving D. Wheel | 144.9 | | |
| 3 Enter H. Wheel | 138.1 | | |
| 4 Leaving H. Wheel | 78.5 | | |
| 5 Leaving Evaporator | 66.7 | 92.82 | 30.46 |
| 6 Entering Evaporator | 84.2 | 99.7 | 35.84 |
| 7 Entering H. Wheel | 74.4 | 123. | 37.07 |
| 8 Leaving H. Wheel | 136.1 | | |
| 9 Entering D. Wheel | 154. | | |

-continued

| TEST NO. II | | | |
|---|---|---|---|
| Location | T Avg. Air Temp (F.) | W Avg. Air Humidity (Grains/lb) | H Air Enthalpy (BTU/lb) |
| 10 Leaving D. Wheel | 114.6 | | |

Pressure drop across H. Wheel (inches $H_2O$) - Supply Side: .37 Return Side: .38
SCFM: 850

Temperature Balance on H. Wheel $\frac{(T3 - T4)}{(T8 - T7)}$ : .966

H. Wheel Effectiveness: .936

External Heat Input: (T1 − T8) × .075 × .24 × 60 × CFM: 16400

Tons of Cooling $\frac{(H_6 - H_5) \times .075 \times 60 \times CFM)}{12{,}000}$ : 1.71

Coefficient of performance (COP) =

$\frac{\text{Cooling}}{\text{Heat}}$ $\frac{(1.71 \times 12{,}000\ \text{BTU/Hr})}{16{,}400} = 1.25$ As previously noted, the axial passages through both the moisture transfer wheel and the heat exchanger wheel may be formed in a manner other than that shown in FIGS. 5 and 6. Other configurations are illustrated in FIGS. 11 and 12, although the invention is not to be limited thereto.

Figure 11:
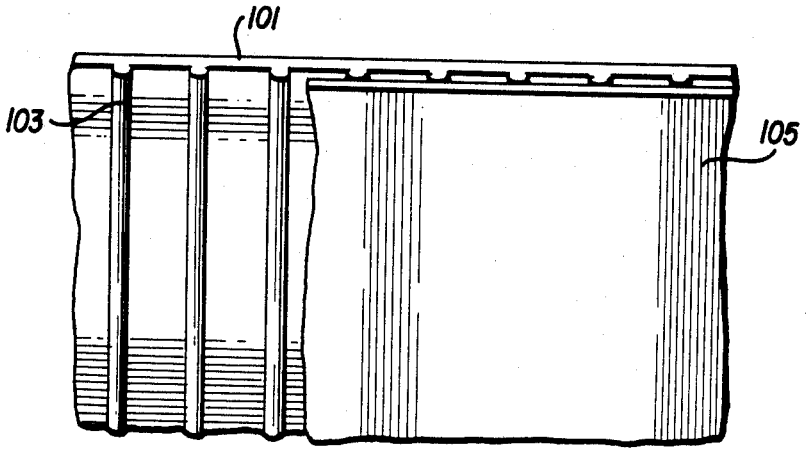
FIG. 11 is a partial break-away view of a modification of the heat exchanger wheel of FIG. 1.

FIG. 11 illustrates a rigid polymer layer 101 which has been extruded so as to include transverse wall 103 along the length thereof. Layer 105 may be absorbent material in the moisture transfer wheel, or rigid polymer for the heat exchanger wheel. When the layers are wound about the hub, walls 103 extend from layer 101 and abut layer 105 so as to form the desired axial channels.

Figure 12:
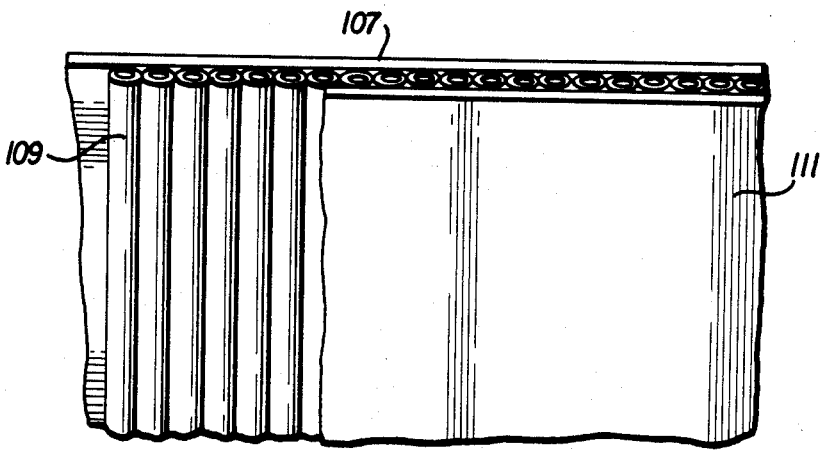
FIG. 12 is a partial break-away view of a further modification of the heat exchanger of FIG. 1.

In FIG. 12, rigid polymer layer 107 has affixed thereto, by any appropriate sealing means, a plurality of abutting tubes 109 of a predetermined diameter. Again, layer 111 may be absorbent material in the moisture transfer wheel or a rigid polymer in the heat exchanger wheel. When the layers are wound about the hub, the outer surface of tubes 109 abuts layer 111 so as to form the desired axial passages. It is obvious that the tubes could also be rectangular.

The above description and drawings are illustrative only since structural modifications may be made in the various components without departing from the scope of the invention which is to be limited only by the following claims.

What is claimed is:

1. In an open-cycle air-conditioning apparatus including a rotatable heat exchanger wheel, a rotatable desiccant carrying moisture transfer wheel, evaporator means, heating means disposed between said heat exchanger wheel and moisture transfer wheel, and means for passing air through said heat exchanger wheel and said moisture transfer wheel in an intake/exhaust path, the improvement in said moisture transfer wheel comprising a hub and shaft assembly;

alternate layers of rigid material and absorbent material wound about said hub and shaft so as to form a wheel of a predetermined diameter and width;

means between said alternate layers for forming axial passages across said wheel;

a semi-rigid rim secured about the circumference of said wheel;

a plurality of rigid spokes secured to said hub and passing radially through said alternate layers and said rim for structurally strengthening said wheel; and adjustable means on said spokes bearing against the exterior of said rim for truing said wheel.

2. In an open-cycle air-conditioning apparatus including a rotatable heat exchanger wheel, a rotatable desiccant carrying moisture transfer wheel, evaporator means, heating means disposed between said heat exchanger wheel and moisture transfer wheel, and means for passing air through said heat exchanger wheel and said moisture transfer wheel in an intake/exhaust path, the improvement in said heat exchanger wheel comprising a hub and shaft;

first and second layers of rigid material alternately wound about said hub and shaft so as to form a wheel of a predetermined width and diameter;

means between said first and second layers for forming axial passages across said wheel;

a semi-rigid rim secured about the circumference of said wheel;

a plurality of rigid spokes secured to said hub and passing radially through said first and second layers of said film and said rim for structurally strengthening said wheel; and adjustable means on said spokes bearing against the exterior of said rim for truing said wheel.

3. The apparatus of cliam 2 wherein said means for forming said axial passage comprises corrugations in one of said rigid layers.

4. The apparatus of claims 1 or 2 wherein said rigid spokes are arranged in pairs on opposite sides of said wheel, with the spokes of each pair being axially aligned across said wheel.

5. In an open-cycle air-conditioning apparatus including a rotatable heat exchanger wheel, a rotatable moisture transfer wheel, evaporator means, heating means disposed between said heat exchanger wheel and moisture transfer wheel, and means for passing air through said heat exchanger wheel and said moisture transfer wheel in an intake/exhaust path, the improvement in said moisture transfer wheel comprising a hub and shaft assembly having a predetermined width;

alternate layers of rigid material and absorbent material wound about said hub and said shaft so as to form a wheel of a predetermined diameter and width;

means between said alternate layers for forming axial passages across said wheel;

a desiccant carried on and within said absorbent material; and a moisture impervious grid impregnated in and extending to the surface of said absorbent material so as to prevent migration of said desiccant within said absorbent material during rotation of said wheel and to inhibit spillage of said desiccant when said wheel is at rest.

6. The apparatus of claims 1 or 5 wherein said means for forming said axial passages comprises corrugations in said rigid layer.

7. The apparatus of claims 1 or 2 or 5 wherein said means for forming said axial passages comprises a plurality of substantially transverse walls extending between said layers.

8. The apparatus of claims 1 or 2 or 5 wherein said means for forming said axial passages comprises a plurality of transverse abutting tubes secured between said layers.

9. The apparatus of claims 1 or 5 wherein said rigid material is a polymer film.

10. The apparatus of claims 1 or 5 wherein said absorbent material is paper.

11. The apparatus of claims 1 or 5 wherein said absorbent material is a non-woven polymer.

12. The apparatus of claim 5 wherein said moisture impervious grid is glue.

13. The apparatus of claim 15 wherein said absorbent material comprises a non-woven polymer.

14. The apparatus of claim 5 wherein said absorbent material comprises paper.

15. In an open-cycle air-conditioning apparatus including a rotatable heat exchanger wheel, a rotatable desiccant carrying moisture transfer wheel, evaporator means, heating means disposed between said heat exchanger wheel and moisture transfer wheel, and means for passing air through said heat exchanger wheel and said moisture transfer wheel in an intake/exhaust path, the improvement in said apparatus comprising at least one baffle means extending between said moisture transfer wheel and said heat exchanger wheel parallel to the air flow in said air intake path, said baffle means extending between the axes and outer periphery of said wheels, so as to prevent undesirable intermingling of air having different temperatures and humidity levels in said intake path between said wheels.

16. The apparatus of claims 1, 2, 5 or 15 wherein said desiccant is lithium chloride.

17. The apparatus of claims 1, 2, 5 or 15 wherein said heating means is a solar coil.

18. The apparatus of claim 15 wherein said baffle means is a rigid plate extending radially from and adjacent to the axis of said wheels to the outer portion of said wheel in said air intake path.

19. A rotary moisture transfer wheel for removal of moisture from air passing therethrough in an intake/exhaust path comprising a hub and shaft assembly;

alternate layers of rigid material and absorbent desiccant carrying material wound about said hub and shaft so as to form a wheel of a predetermined diameter and width;

means between said alternate layers for forming axial passages across said wheel;

a semi-rigid rim secured about the circumference of said wheel;

a plurality of rigid spokes secured to said hub and passing through said alternate layers and said rim for structurally strengthening said wheel; and adjustable means on said spokes bearing against the exterior of said rim for truing said wheel.

20. The wheel of claim 19 wherein said means for forming said axial passages comprises corrugations in said rigid layer.

21. The wheel of claim 19 wherein said means for forming said axial passages comprises a plurality of substantially transverse walls extending between said layers.

22. The wheel of claim 19 wherein said means for forming said axial passages comprises a plurality of transverse tubes secured between said layers.

23. The wheel of claim 19 wherein said absorbent material is paper.

24. The wheel of claim 19 wherein said absorbent material is a non-woven polymer.

25. The wheel of claim 19 wherein said rigid material is a polymer film.

26. The wheel of claim 19 wherein said desiccant is lithium chloride.

27. The wheel of claim 19 wherein said absorbent material is impregnated with a moisture impervious grid.

28. The wheel of claim 27 wherein said moisture impervious grid is glue.

29. A rotary counter flow heat exchanger wheel for changing the temperature of air passing therethrough comprising a hub and shaft;

first and second layers of rigid polymer material alternately wound about said hub and shaft so as to form a wheel of a predetermined width and diameter;

means between said first and second layers for forming axial passages across said wheel;

a semi-rigid rim secured about the circumference of said wheel;

a plurality of rigid spokes secured to said hub and passing radially through said first and second layers of said film and said rim for structurally strengthening said wheel; and adjustable means on said spokes bearing against the exterior of said rim for truing said wheel.

30. The wheel of claim 29 wherein said means for forming said axial passages comprises corrugations in said first layer.

31. The wheel of claim 29 wherein said means for forming said axial passages comprises a plurality of substantially transverse walls extending between said first and second layers.

32. The wheel of claim 29 wherein said means for forming said axial passages comprises a plurality of transverse tubes secured between said first and second layers.

33. The wheel of claim 29 wherein said layers of polymer film have a thermal conductivity less than 3.00 BTU/Hr $Ft^{2}$° F./in.

34. The wheel of claim 29 wherein said layers of polymer film have a specific heat greater than 0.25 BTU/Lb.° F.

35. The wheel of claim 29 wherein said layers of polymer film have a density greater than 70 $lb/ft^3$.

36. The wheel of claim 19 or 29 wherein said rigid spokes are arranged in pairs on opposite sides of said wheel with the spokes of each pair being axially aligned across said wheel.

* * * * *